US006193428B1

(12) United States Patent
Dietlmeier

(10) Patent No.: US 6,193,428 B1
(45) Date of Patent: Feb. 27, 2001

(54) ROLLER FOR APPLYING PAINTS OR SIMILAR APPLICATION MASSES

(76) Inventor: Thomas Dietlmeier, Schlesische Strasse 15, D-94327 Bogen (DE)

( * ) Notice: Subject to any disclaimer, the term of this patent is extended or adjusted under 35 U.S.C. 154(b) by 0 days.

(21) Appl. No.: 09/395,995

(22) Filed: Sep. 15, 1999

(30) Foreign Application Priority Data

| | | |
|---|---|---|
| Sep. 16, 1998 | (DE) | 298 16 610 U |
| Aug. 5, 1999 | (DE) | 199 37 022 |
| Sep. 10, 1999 | (DE) | 199 43 324 |

(51) Int. Cl.[7] ..... B05C 1/00; B05C 17/025; B05C 17/03; B05C 17/035; B43M 11/06

(52) U.S. Cl. ..... 401/197; 401/196; 401/208

(58) Field of Search ..... 401/197, 208, 401/218, 219, 220, 196, 147

(56) References Cited

U.S. PATENT DOCUMENTS

| | | | | |
|---|---|---|---|---|
| 3,612,707 | * | 10/1971 | Herbrechter | 401/197 |
| 3,879,140 | * | 4/1975 | Ritter | 401/197 |
| 4,943,176 | * | 7/1990 | Baker | 401/197 |
| 5,419,003 | * | 5/1995 | Tollasepp | 401/197 |
| 6,036,392 | * | 3/2000 | Er | 401/197 |

* cited by examiner

*Primary Examiner*—Henry J. Recla
*Assistant Examiner*—Tuan Nguyen
(74) *Attorney, Agent, or Firm*—Hoffman, Wasson & Gitler

(57) ABSTRACT

A roller for applying paint or similar coating masses to surfaces or articles. The roller has an inner drum which forms a reservoir for the application mass and which has a peripheral surface which is made rotationally symmetrical to one drum axis, and with an outer drum which is arranged to turn freely and which has first openings in a peripheral surface which surrounds the inner drum.

13 Claims, 3 Drawing Sheets

ROLLER FOR APPLYING PAINTS OR SIMILAR APPLICATION MASSES

BACKGROUND OF THE INVENTION

The invention relates to a roller for applying paints or similar application masses to surfaces or articles.

It is an object of the present invention to provide a roller which with economical execution and simple handling enables time-saving, uniform and drip-free application of paints or other application masses.

SUMMARY OF THE INVENTION

To accomplish this objective, a roller is made with an inner drum which forms a reservoir for the paint and with a peripheral surface which is made rotationally symmetrical to a drum axis, and with an outer drum which turns freely and has openings in a peripheral surface which surrounds the inner drum.

In the invention, the outer drum can turn on the inner drum, i.e. the inner drum forms, for example, the bearing of the outer drum, by which an especially good distribution of the paint or application mass results.

BRIEF DESCRIPTION OF THE FIGURES

The invention is detailed below using the following figures.

DETAILED DESCRIPTION OF THE INVENTION

Figure 1:
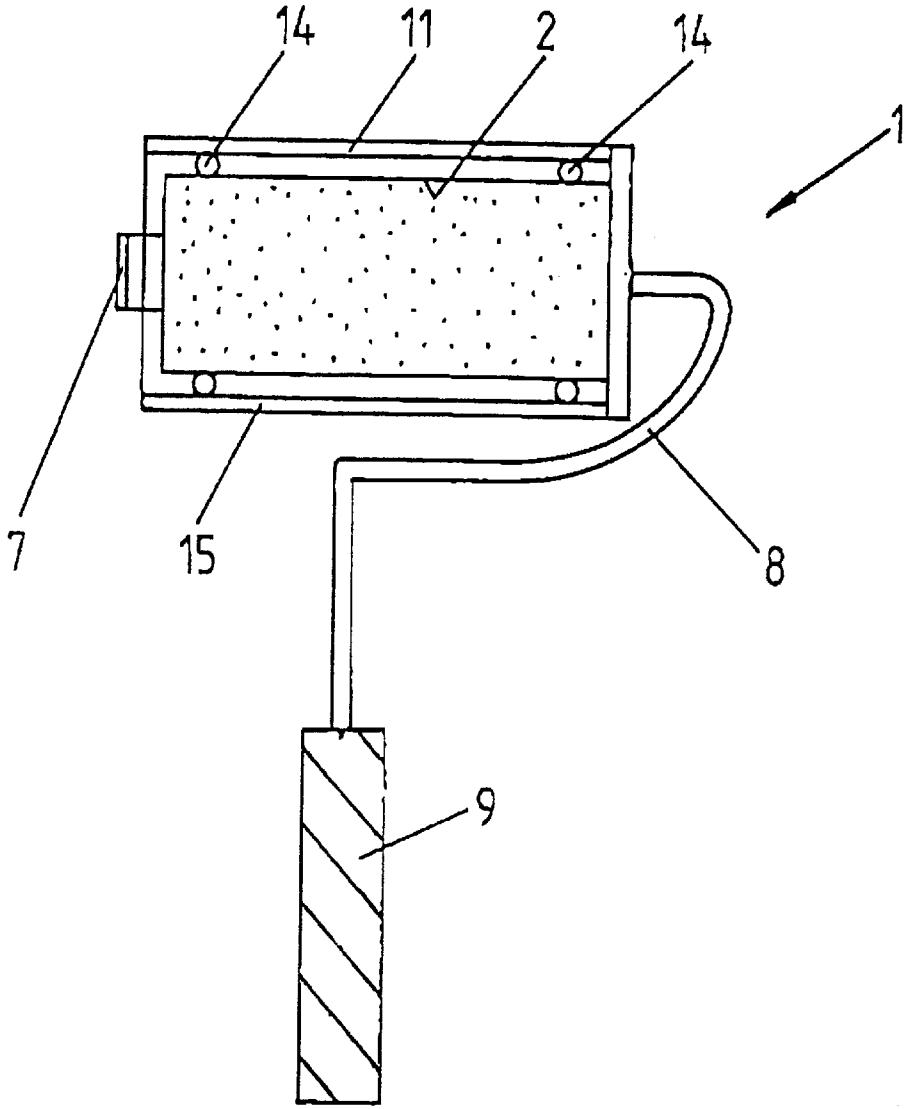
FIG. 1 shows in a simplified representation, a paint roller as claimed in the invention.

The roller labelled 1, in general, in the figures is used, for example, for applying paint to walls and/or surfaces of buildings, for example, to walls, or ceilings, of building interiors. However, the roller 1 can also be used to apply paint, or other masses, to other surfaces.

The roller consists essentially of an inner drum 2 which is formed by a closed cylindrical body 3 with a circular cylindrical peripheral wall. The interior of the cylindrical body 3, surrounded by the peripheral wall 4, is closed on both ends by an end wall 5 or 6. On the end wall 5, there is a closable cover 7 for refilling the inner drum 2 with paint. One end of the inner drum 2 is a retaining clip 8, which has a handle 9, and on the other end, is attached, an end wall 6.

In the peripheral wall 4, there are a plurality of openings 10, which are made in this embodiment as slots, which run with their lengthwise extension in the peripheral direction.

The outer drum is labelled 11. It consists essentially of a circular cylindrical peripheral wall 12 which has a plurality of openings 13 with a cross section which is smaller than the cross section of the plurality of openings 10. The cross-section can also be larger or equal. In the embodiment shown, the plurality of openings 13 are holes. On one side, a bottom 12' which is provided with a center opening, adjoins the peripheral wall.

In the roller 1, which is ready to use the outer drum 11 surrounds the inner drum 2, over its entire length. The drum

11 can be slipped onto the drum 2, and can be fixed there by catching such that the outer drum 11 can turn freely on the inner drum 2. For this purpose, for example, two slotted rings 14 are held in grooves of the inner drum 2, which fit into the corresponding grooves of the outer drum when slipped on.

Figure 2:
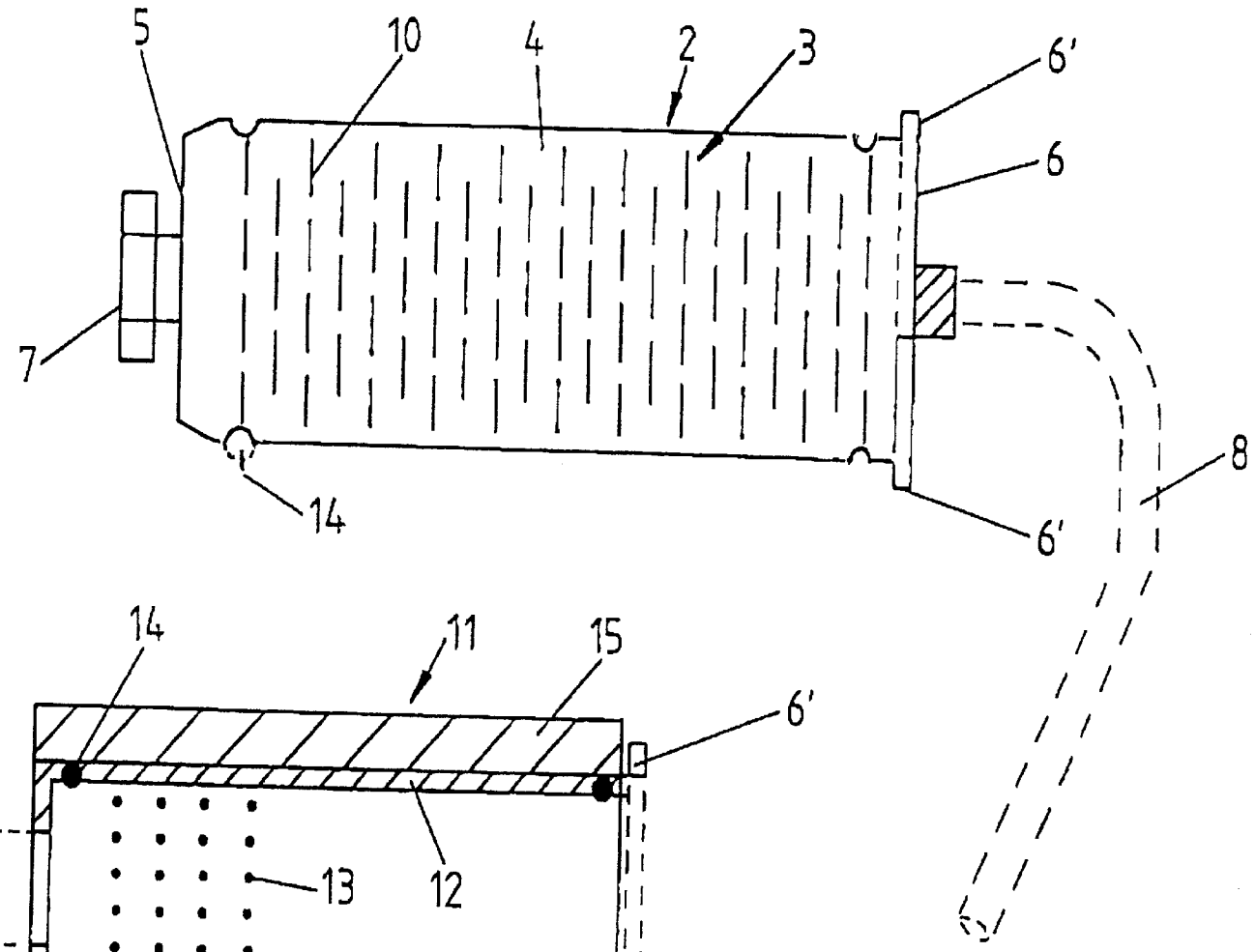
FIG. 2 shows in an enlarged representation, the inner drum of the paint roller of FIG. 1.
Figure 3:
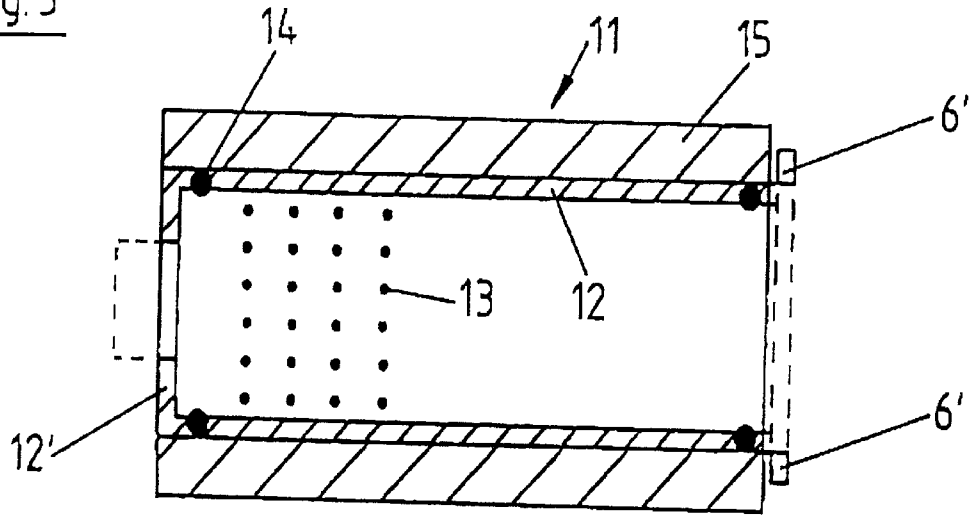
FIG. 3 shows in a simplified representation, the outer drum of the paint roller of FIG. 1.

As FIG. 2 shows, the end wall 6 forms a radially projecting flange 6' over the peripheral surface of the peripheral wall 4. This flange and the adjacent ring 14 prevent lateral emergence of paint on the end wall. The bottom 12', with the adjacent ring 14, prevents emergence of paint on the end wall 5. Furthermore, the bottom 12' is used to strengthen the drum 11. On the drum 11 is a support 15 of soft material permeable to paint. This support can be a foam material.

When paint is applied to a surface it passes from the interior of the inner drum 2 through the openings 10, through the openings 13 of the turning drum 11 and through the support 15 on its surface, where the paint is then delivered to the surface. The viscous properties of the paint ensure that when the outer drum 11 turns, paint is removed from the drum 2 through the plurality of openings 10. This occurs by a type of suction effect so that drip-free paint application is possible.

The inner drum 2 can also be made as a paint cartridge.

Figure 4:
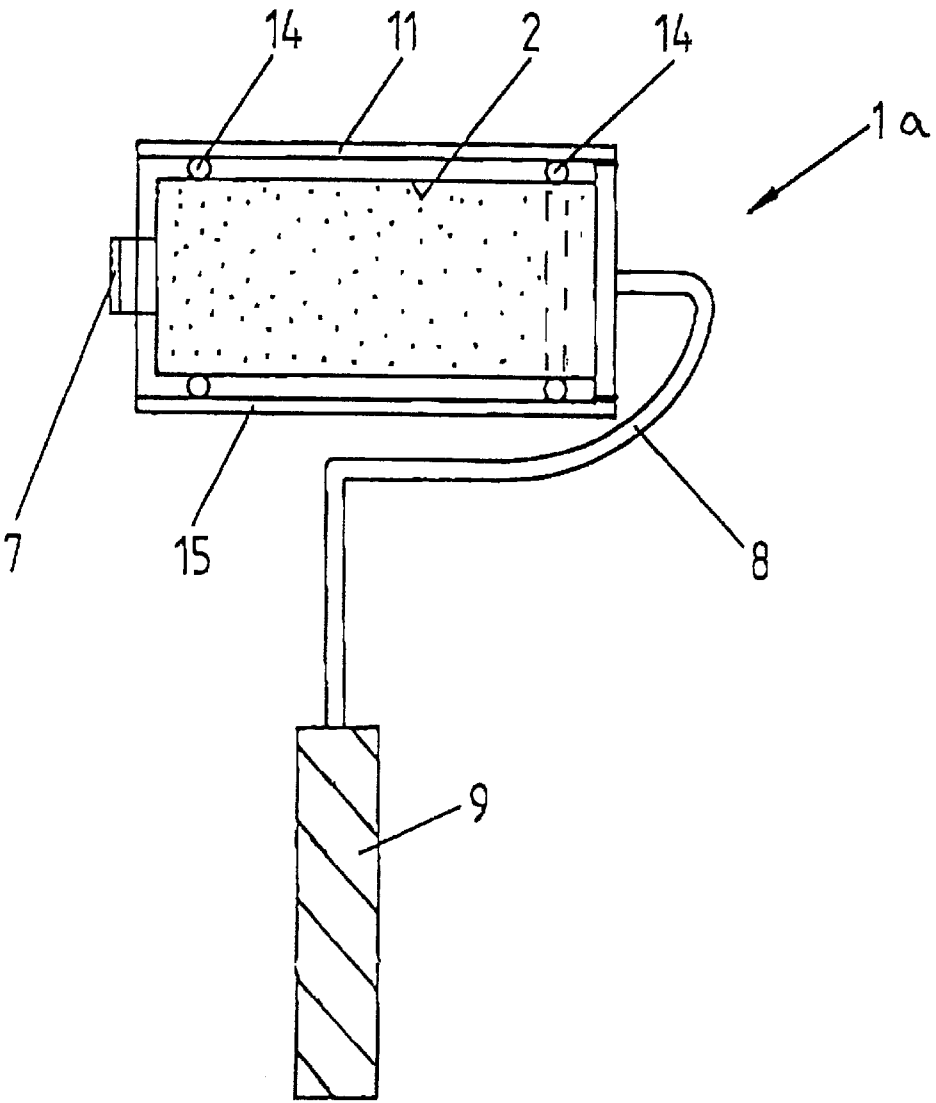
FIG. 4 shows in the representation of FIG. 1 another embodiment of the paint roller as claimed in the invention.

FIG. 4 shows a representation similar to FIG. 1, wherein a paint roller la, which differs from the paint roller 1, essentially in that the outer drum extends to over the end wall 6, of the inner drum 2, or encompasses this end wall 6. Lateral emergence of paint is prevented by rings 14, and especially by the ring 14 adjacent to the end wall 6. The openings 10, of at least of the inner drum 2, are located on the area which is surrounded by the outer drum 11 and which is sealed by the aforementioned ring 14, i.e. on an area of the peripheral wall 4 of the inner drum 2. The (area) has a distance from the end wall 6 which is greater than the corresponding distance between this end wall 6 and the adjacent ring 14.

What is claimed is:

1. A roller for applying paint or similar application masses to surfaces or articles, said roller comprising:

an inner drum having one closed end fixed against rotation to a handle;

said inner drum having a peripheral surface with a plurality of first openings, said peripheral surface being rotationally symmetrical to a drum axis of said inner drum;

said inner drum forming a reservoir for the application masses, said reservoir having an access port with a closable cover at the opposite end of said inner drum;

an outer drum arranged to turn freely on said inner drum and having a plurality of second openings in a peripheral surface which surrounds said inner drum;

said outer drum being removably fixed by catching on said inner drum; and wherein said access port remains closed when said outer drum is removed from said inner drum.

2. A roller as claimed in claim 1, further comprising slotted rings on said inner drum, which fit into grooves of said outer drum when said outer drum is slipped onto said inner drum.

3. A roller as claimed in claim 2, wherein said slotted rings prevents emergence of said application masses on an end wall of said inner drum.

4. A roller as claimed in claim 1, wherein said inner drum is a paint cartridge.

5. The roller as claimed in claim 1, wherein said peripheral surface of said inner drum and said outer drum is cylindrical.

6. The roller as claimed in claim 1, further comprising on an outer surface of said outer drum a jacket of soft, elastic material.

7. The roller as claimed in claim 6, wherein said jacket is removable.

8. The roller as claimed in claim 1, wherein said plurality of second openings have a larger cross section than said first openings.

9. The roller as claimed in one claim 1, wherein said plurality of first openings have a larger cross section than said plurality of second openings.

10. The roller as claimed in claim 1, wherein said plurality of first openings and said plurality of second openings have a same cross section.

11. The roller as claimed in claim 1, wherein said plurality of second openings are slots which extend in a peripheral direction of said peripheral surface.

12. The roller as claimed in claim 1, wherein said inner drum is connected to a torsionally strong handle.

13. The roller as claimed in claim 12, wherein said handle is removable from the inner drum.

* * * * *